US007226402B1

(12) United States Patent
Joya

(10) Patent No.: US 7,226,402 B1
(45) Date of Patent: Jun. 5, 2007

(54) EXERCISE DEVICE FOR EXERCISING THE MAJOR MUSCLE GROUPS OF THE MIDDLE AND LOWER TORSO

(76) Inventor: Pedro Flores Joya, 40 Aspetuck Village, New Milford, CT (US) 06776

( * ) Notice: Subject to any disclaimer, the term of this patent is extended or adjusted under 35 U.S.C. 154(b) by 0 days.

(21) Appl. No.: 11/129,640

(22) Filed: May 16, 2005

(51) Int. Cl.

| | |
|---|---|
| ***A63B 21/02*** | (2006.01) |
| ***A63B 21/04*** | (2006.01) |
| ***A63B 53/06*** | (2006.01) |
| ***A63B 53/16*** | (2006.01) |
| ***A63B 69/36*** | (2006.01) |

(52) U.S. Cl. ..... 482/121; 482/126; 482/129; 482/130; 473/266; 473/272; 473/273

(58) Field of Classification Search ..... 482/121, 482/126, 100, 122, 129, 130, 133–134, 103; 473/218–277

See application file for complete search history.

(56) References Cited

U.S. PATENT DOCUMENTS

| | | | | |
|---|---|---|---|---|
| 1,585,748 | A * | 5/1926 | Wendelken | 482/143 |
| 2,060,938 | A | 11/1936 | Johnson | 272/57 |
| 3,415,524 | A * | 12/1968 | Vickers | 473/214 |
| 3,926,430 | A * | 12/1975 | Good, Jr. | 482/112 |
| 5,090,694 | A * | 2/1992 | Pauls et al. | 482/118 |
| 5,176,601 | A * | 1/1993 | Reynolds | 482/130 |
| 5,234,394 | A * | 8/1993 | Wilkinson | 482/92 |
| 5,466,204 | A * | 11/1995 | Nearing | 482/102 |
| 5,997,448 | A * | 12/1999 | Duba | 482/121 |
| 6,059,699 | A | 5/2000 | Ramsey | 482/94 |
| 6,099,445 | A * | 8/2000 | Rovinsky et al. | 482/121 |
| 6,113,522 | A * | 9/2000 | Fontenot et al. | 482/111 |
| 6,174,270 | B1 * | 1/2001 | Dagenais | 482/148 |
| 6,267,711 | B1 * | 7/2001 | Hinds | 482/121 |
| 2005/0130814 | A1 * | 6/2005 | Nitta et al. | 482/121 |

* cited by examiner

*Primary Examiner*—Stephen R. Crow
*Assistant Examiner*—Arun Chhabra
(74) *Attorney, Agent, or Firm*—LaMorte & Associates

(57) ABSTRACT

An exercise device for exercising the major muscle groups of the middle and lower torso. The exercise device has a self-standing framework that includes a vertical post. A cross beam is provided that has two ends and a middle section. The middle section of the cross beam is connected to the vertical post with a pivot connection. The pivot connection enables the cross beam to move relative to the vertical post throughout a predetermined range of motion. A person exercises by grabbing and pulling a handle. The handle is attached to at least one resistance element. By adjusting the orientation of the cross beam, the handles and resistance elements can be selectively positioned at various heights and at various offset orientations relative to a support platform.

11 Claims, 6 Drawing Sheets

EXERCISE DEVICE FOR EXERCISING THE MAJOR MUSCLE GROUPS OF THE MIDDLE AND LOWER TORSO

BACKGROUND OF THE INVENTION

1. Field of the Invention

The present invention relates to exercise equipment designed to exercise muscle groups contained within the middle and lower torso. More particularly, the present invention relates to exercise equipment that provides resistance to the twisting and bending motions of the torso.

2. Prior Art Description

Of all the areas of the body that people would like to improve with exercise, the area of the lower torso is one of the most prevalent. Both men and women have a tendency to store extra weight around their waists. Additionally, the major muscle groups of the lower torso tend to lose tone as a person ages or otherwise becomes less active. The combination of added fat and loss of muscle tone causes the waistline of the person to expand, thereby causing the person to appear flabby.

Although many pieces of exercise equipment exist, few pieces of exercise equipment are dedicated to exercising the major muscle groups of the lower torso. The major muscle groups of the lower torso include the external oblique muscles, the internal oblique muscles, the transverse abdominis muscles and the rectus abdominis muscles. All of these muscle groups wrap around the torso and are therefore present on the front, back and sides of the torso.

Prior art exercise machines that are designed to exercise the lower torso are usually sit-up machines that help a person perform sit-up exercises. Although sit up exercises are good for conditioning the muscles in the front of the torso, they do little to condition the muscles that extend around the sides and back of the torso. Consequently, sit-up exercises alone are insufficient to properly condition the muscle groups of the lower torso.

In order to properly condition the major muscle groups of the lower torso, exercises must be performed that cause the torso to both twist and bend. In the past, many personal trainers condition the muscles of the middle and lower torso by having people perform twisting and bending exercises with the use of medicine balls. Medicine balls are weighted balls that are sized to be grasped and lifted with two hands. By having a person lift a medicine ball from one position and move it to another, many bending and twisting exercises of the lower torso can be created. Prior art devices that guide the movement of the medicine ball are exemplified by U.S. Pat. No. 6,059,699 to Ramsey, entitled Medicine Ball Torso Rack, and U.S. Pat. No. 2,060,938 to Johnson, entitled Exercise Device.

Although exercises with medicine balls can properly exercise the major muscle groups of the lower torso, the resistance provided by the medicine balls is limited. Medicine balls are heavy and provide resistance only to upward vertical movement. Medicine balls provide no resistance to horizontal movement or downward vertical movement. Consequently, the amount of conditioning that can be provided using a medicine ball is limited.

A need therefore exists for an exercise device that exercises the major muscle groups of the middle and lower torso, but is capable of providing resistance to all bending and twisting motions, both vertically and horizontally. This need is met by the present invention as described and claimed below.

SUMMARY OF THE INVENTION

The present invention is an exercise device that is particularly well suited for exercising the major muscle groups of the middle and lower torso. The exercise device has a self-standing framework that includes a vertical post. A cross beam is provided that has two ends and a middle section. The middle section of the cross beam is connected to the vertical post with a pivot connection. The pivot connection enables the cross beam to move relative to the vertical post throughout a predetermined range of motion.

A person exercises by grabbing and pulling a handle. The handle is attached to at least one resistance element that resists being pulled in tension. By adjusting the orientation of the cross beam, the handles and resistance elements can be selectively positioned at various heights and at various offset orientations relative to a support platform. Thus, a person sitting or lying on the support platform is required to bend and/or twist when pulling upon a handle. The resistance element resists the bending and twisting of the body throughout such movements. As a result, highly effective exercises can be performed that target the major muscle groups in the torso that are used in the bending and twisting of the torso.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention exercise device can be configured to exercise the various muscles groups of the arms, legs and shoulders, the exercise device is particularly well suited for exercising the major muscle groups of the middle and lower torso. Consequently, the few exercise positions illustrated and described will be for people exercising the muscles of the middle and lower torso in order to set forth the best mode contemplated for the invention. However, the shown exercise positions should not be considered a limitation on the uses of the present invention exercise device and it will be understood that other exercises can be performed using the exercise device.

Figure 1:
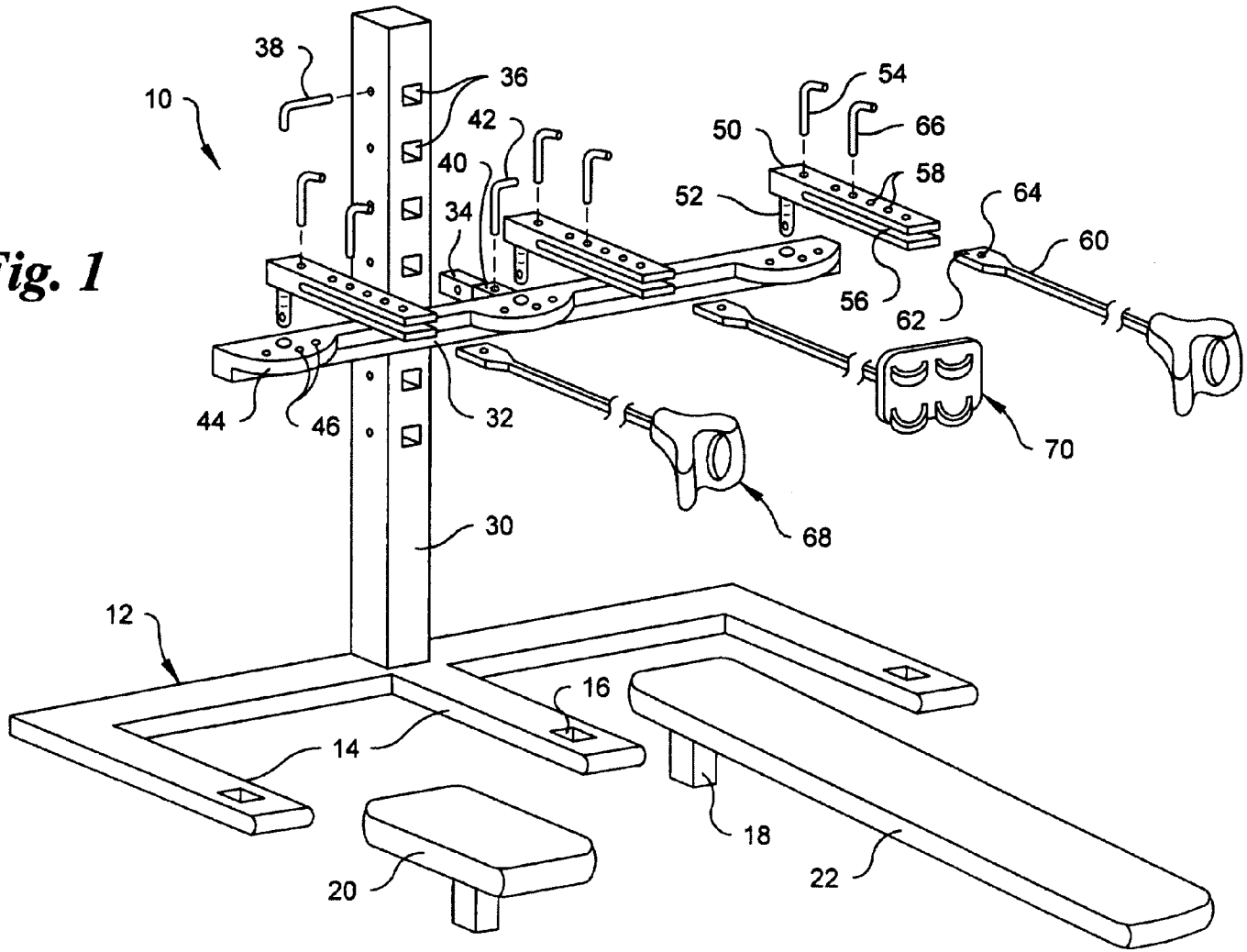
FIG. 1 is an exploded perspective view of an exemplary embodiment of the present invention exercise device.

Referring to FIG. 1, an exemplary embodiment of the present invention exercise device 10 is shown. The exercise device 10 has a base 12 that lay flush upon the floor. The base 12 has at least one lateral element 14. In the shown embodiment, three lateral elements 14 are shown on the base 12. The shown configuration is free standing and highly stable. However, it will be understood that this is an exemplary number and one, or any plurality, of lateral elements 14 can be used, provided the base 12 is in a stable configuration.

A mounting recess 16 is disposed at the end of each of the lateral elements 14. The mounting recess 16 is shaped and sized to receive the post 18 of a support platform. The support platform can be either a stool support platform 20 or a bench support platform 22. The post 18 of either type of support platform can be a static structure or can be adjustable in length. This allows for either support platform to be adjusted to match the needs of the person using the exercise device 10.

A vertical post 30 extends upwardly from the base 12. The vertical post 30 preferably has a height of between three feet and six feet. A cross beam 32 is provided that is supported in an elevated position by the vertical post 30. A pivot arm 34 is used to join the cross beam 32 to the vertical post 30. In the shown embodiment, mounting holes 36 are disposed along the length of the vertical post 30. Each of the mounting holes 36 is sized and shaped to receive one end of the pivot arm 34. A pin 38 is used to lock the pivot arm in place within one of the mounting holes 36. By selectively attaching the pivot arm 34 to one of the available mounting holes 36, the height of the pivot arm 34, and the cross beam 32 it supports, can be selectively altered.

A collar 40 extends laterally from the cross beam 32, at or near the center of the cross beam 32. The collar 40 accepts the pivot arm 34, whereby the cross beam 32 is free to rotate about the pivot arm 34 as the collar 40 turns relative to the pivot arm 34. The collar 40 and the cross beam 32, however, can be locked into a set position in the pivot arm 34 through the use of a pin 42 that extends through both the collar 40 and the pivot arm 34. It will therefore be understood that the cross beam 32 can be selectively locked into position at an orientation perpendicular to the vertical post 30, parallel to the vertical post 30, or at some angle there between.

At least one mounting flange 44 is disposed on the cross beam 32. In the shown embodiment, three mounting flanges 44 are provided. One mounting flange 44 is in the center of the cross beam 32 and the other mounting flanges 44 are near the two ends of the cross beam 32. Each mounting flange 44 defines a plurality of connection holes 46.

Anchor assemblies 50 are provided. Each anchor assembly 50 has an anchor pin extension 52 that passes into one of the connection holes 46 on a mounting flange 44, thereby joining the anchor assembly 50 to the mounting flange 44. The anchor assemblies 50 are free to rotate about the anchor pin extensions 52 on the mounting flanges 44. Removable locking pins 54 are used to lock the anchor assemblies 50 into desired orientations relative to the cross beam 32. The locking pins 54 pass through the anchor assembly 50 and engage one of the connection holes 46 in the mounting flange 44.

Each anchor assembly 50 has a split construction that defines a central gap 56. Adjustment holes 58 are formed through the anchor assembly 50 that traverse the anchor assembly 50 at points along its length. Resistance bands 60 are provided. Each resistance band 60 has an enlarged head 62 with a central hole 64. The enlarged head 62 is sized to fit into the central gap 56 of an anchor assembly 50. Pins 66 are used to lock the enlarged heads 62 of the resistance bands 60 at different points along the length of the anchor assemblies 50. Each resistance band 60 is elastic, having an unstretched nominal length. The resistance bands 60 can be elastically stretched to lengths longer than their nominal length, however, the resistance bands 60 resist such stretching with a predesigned resistance force.

Each of the resistance bands 60 terminates with either a hand handle 68 or a foot handle 70. The hand handles 68 are shaped to be grasped by a person's hands. The foot handles are shaped to be engaged by a person's feet.

Figure 2:
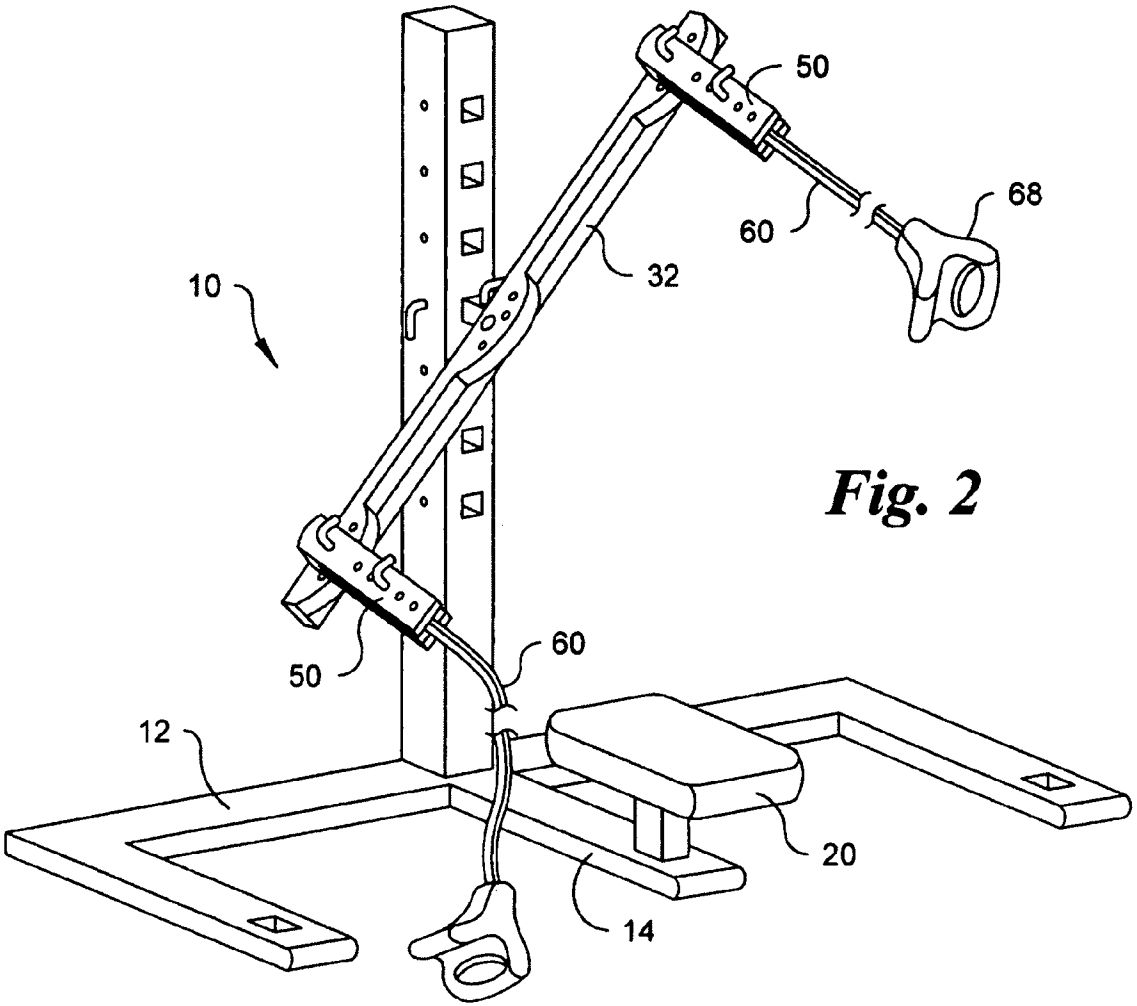
FIG. 2 is a perspective view of the exemplary exercise device configured for a first type of exercise.

Referring now to FIG. 2, it will be understood that the present invention exercise device 10 has many adjustable features that allow the device 10 to be configured in many different ways. In FIG. 2, a stool support platform 20 is set into position on the center lateral element 14 of the base 12. The cross beam 32 is set at an angle, being about forty-five degrees offset from the vertical post 30. Two anchor assemblies 50 are attached to either end of the cross beam 32. Resistance bands 60 with hand handles 68 are attached to the anchor assemblies 50.

Figure 3:
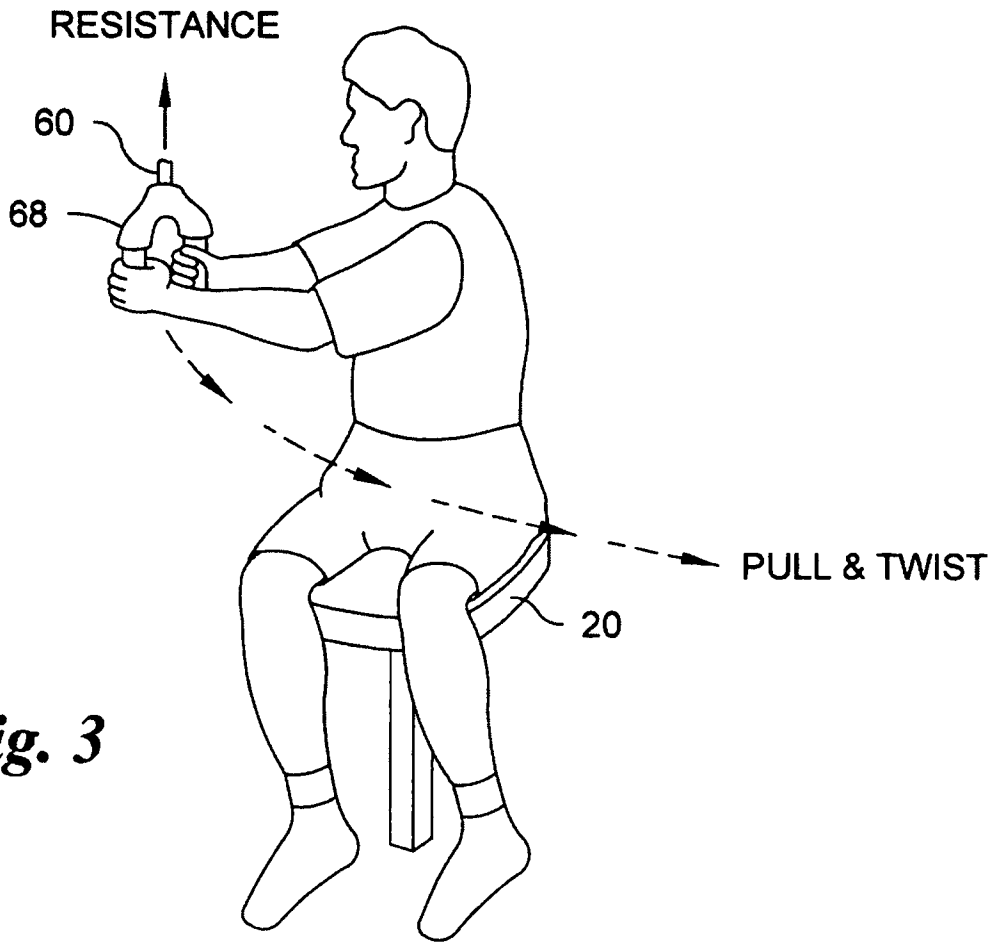
FIG. 3 illustrates how a person performs a first exercise using the exercise device configuration shown in FIG. 2.

Referring to FIG. 3, it will be understood that with the exercise device 10 that is configured like it is in FIG. 2, a person seated on the stool support platform 20 can grab the higher hand handle 68 and pull downwardly. The resistance band 60 resists the pulling of the hand handle 68. The muscles in the middle and lower torso must overcome this resistance as the person attempts to bend and turn his/her body while holding the hand handle 68.

Figure 4:
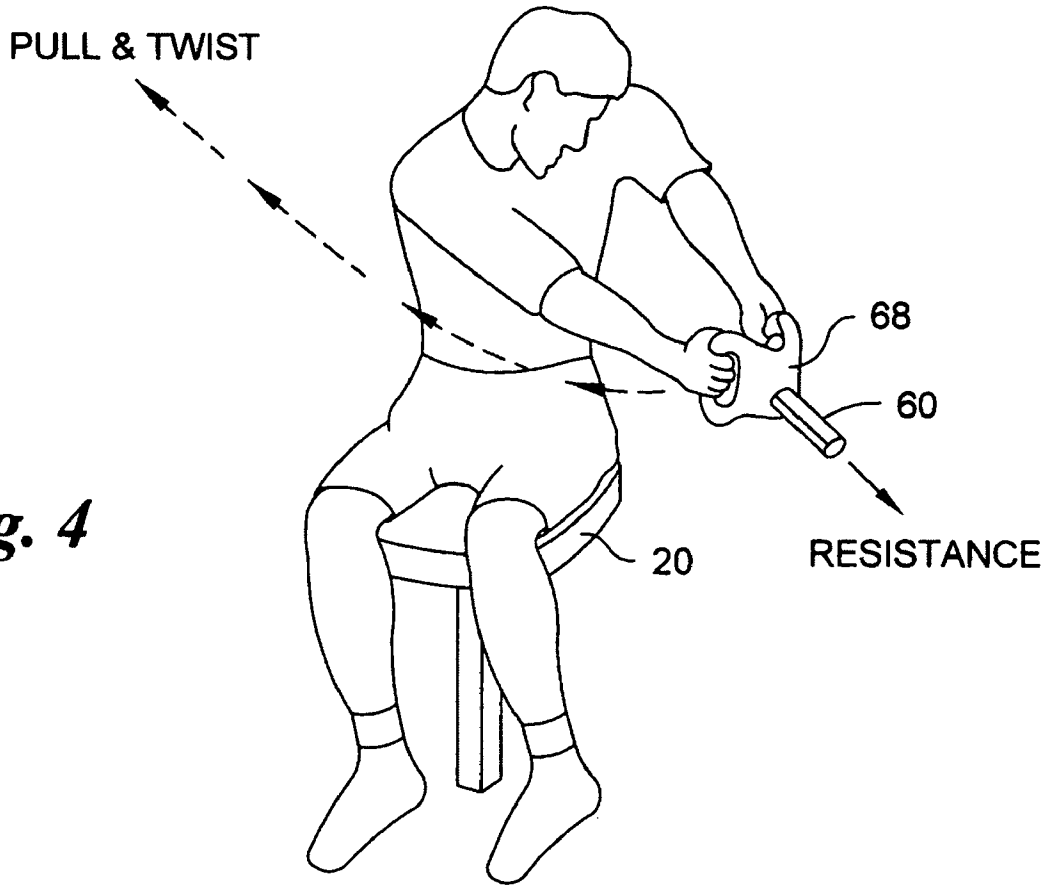
FIG. 4 illustrates how a person performs a second exercise using the exercise device configuration shown in FIG. 2.

Similarly, referring to FIG. 4, it can be seen that a person seated on the stool support platform 20 can grab the lower hand handle 68 and pull upwardly. The resistance band 60 resists the upward movement of the hand handle 68. A person therefore must use the major muscle groups of the middle and lower torso to sit sup and bend his/her body while holding the hand handle 68.

Returning to FIG. 2, it will be understood that the angle of the anchor assemblies 50 can be selectively changed. This allows the resistance bands 60 and hand handles 68 to orient at different angles to accommodate people of different statures and body types. Furthermore, by either lengthening or shortening the distance that the resistance bands 60 extend from the anchor assemblies 50, the resistance provided by the resistance bands 60 can be selectively altered.

Figure 5:
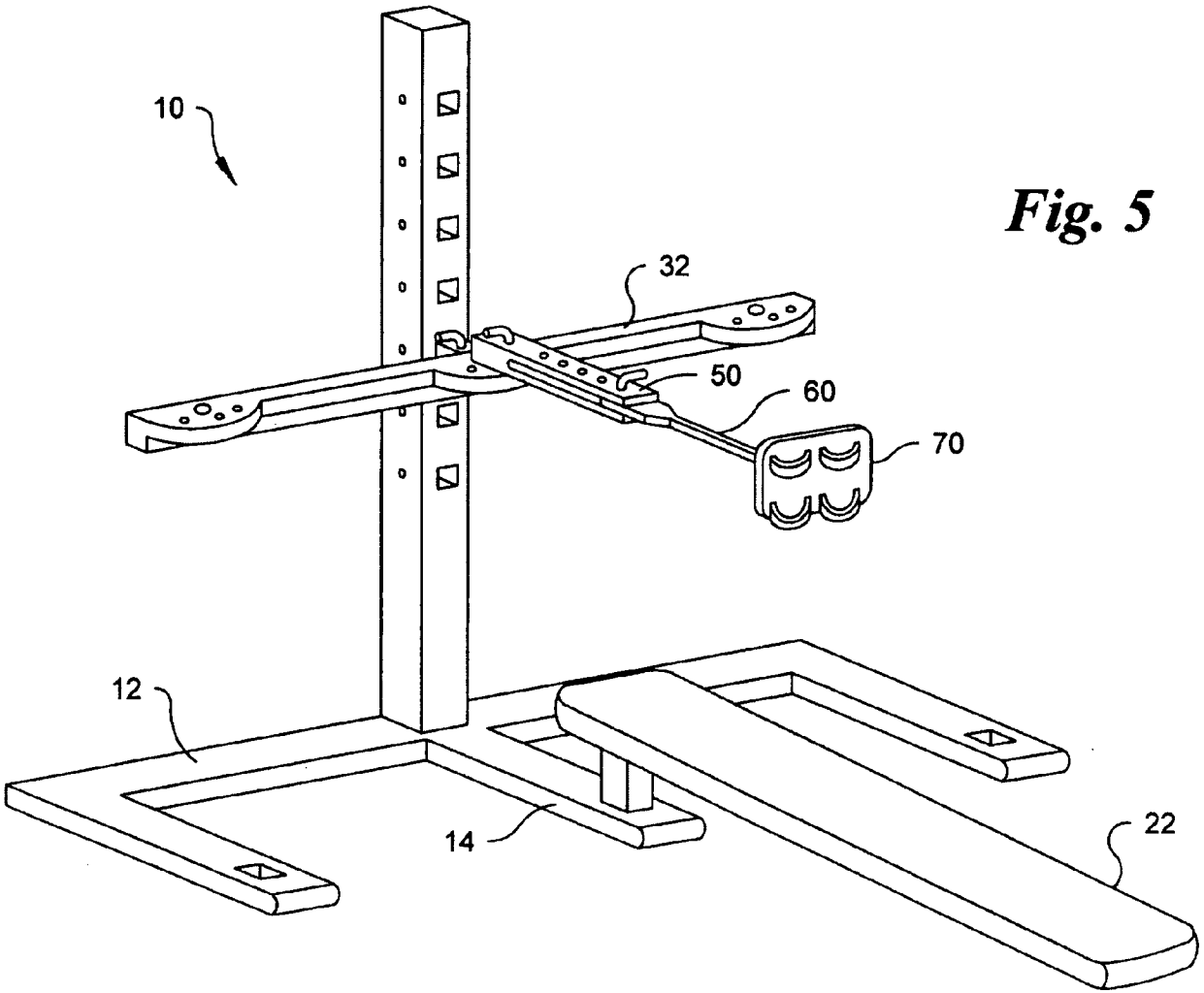
FIG. 5 is a perspective view of a the exemplary exercise device configured for a third type of exercise.

Referring to FIG. 5, a bench support platform 22 is set into position on the center lateral element 14 of the base 12. The cross beam 32 is set at a horizontal orientation. One anchor assembly is attached to the center of the cross beam 32. A resistance band 60 with a foot handle 70 is attached to the anchor assembly 50.

Figure 6:
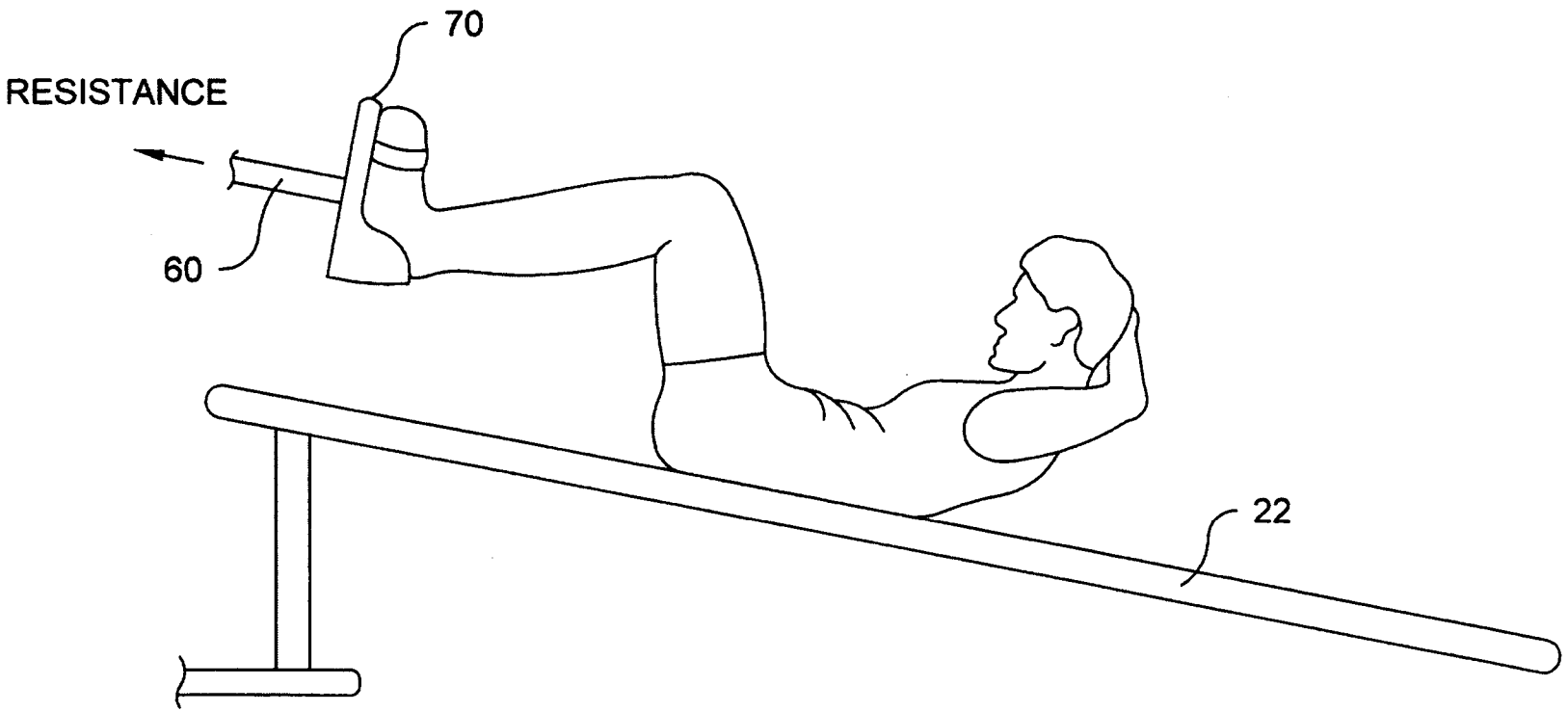
FIG. 6 illustrates how a person performs a third exercise using the exercise device configuration shown in FIG. 5.

Referring to FIG. 6, it can be seen that a person laying on the bench support platform 22 can engage the foot handle 70 with their feet. The person laying on the bench support platform 22 can then attempt to pull the resistance band 60 forward with their feet. This exercises the major muscle groups of the lower torso as well as the legs.

From the exemplary embodiments of the present invention that are shown, it will be understood that by varying the position of the support platform, varying the height of the cross beam, varying the angle of the cross beam, varying the attachment points on the cross beam and varying the length of the resistance straps, hundreds of different exercise configurations can be created. Furthermore, by being able to position resistance bands at points eccentric to the user's body, a great many exercises can be created that require the person to twist their torso while pulling the resistance strap. This exercises the major muscle groups of the middle and lower torso in an effective manner.

It will be understood that the embodiments of the present invention exercise machine that are illustrated and described are merely exemplary and that a person skilled in the art can make many variations to those embodiments, For instance, in the shown embodiment, the cross beam, anchor assemblies and resistance straps are all adjusted using pins and holes. Many other adjustment mechanisms can be used in place of the pins and holes that would produce the same result. All such alternate adjustment mechanisms are intended to be included within the scope of the present invention exercise device as defined by the claims.

Furthermore, it will be understood that the elastic resistance bands shown in the embodiment can be substituted with springs, bands, weighted cables and the like. The manner of providing the resistance to movement can be anything capable of providing such resistance.

It will therefore be understood that a person skilled in the art can make many variations to the shown embodiments of the present invention using functionally equivalent components. All such variations, modifications and alternate embodiments are intended to be included within the scope of the present invention as defined by the claims.

What is claimed is:

1. An exercise device, comprising:

a vertical post;

a pivot arm extending horizontally from said vertical post, wherein said pivot arm is selectively adjustable in position up and down said vertical post;

a cross beam having a first end, a second end and a middle position between said first end and said second end, wherein said pivot arm interconnects with said middle position of said cross beam and enables said cross beam to rotate around said pivot arm throughout a predetermined range of motion during exercise;

a locking pin for selectively locking said cross beam to said pivot arm in a plurality of positions through said predetermined range of motion;

mounting flanges located at said first end, said second end and said middle position of said cross beam;

a handle;

at least one elastic resistance element selectively attaching said handle to one of said mounting flanges, said at least one elastic resistance element resists being pulled in tension with a predetermined resistance force by a user during exercise;

anchor elements that interconnect said at least one elastic resistance element to said mounting flanges wherein said anchor elements are connected to said mounting flanges with pivot connections and said device further includes a mechanism for locking said anchor elements in a selective angular orientation relative said mounting flanges.

2. The device according to claim 1, wherein said pivot arm engages said middle position at a point equidistant from said first end and said second end of said cross beam.

3. The device according to claim 1, further including a base for supporting said vertical post.

4. The device according to claim 3, further including at least one support platform that is coupled to said base.

5. The device according to claim 4, wherein said at least one support platform is selected from a group consisting of stools and benches.

6. The device according to claim 1 further including a seating platform wherein said seating platform can be selectively attached to said base at a point either in front of said vertical post or at a point laterally offset from said vertical post.

7. The device according to claim 1, wherein said predetermined resistance force supplied by said at least one resistance element can be selectively altered.

8. An exercise device, comprising:

a support platform upon which a person may rest, said support platform having a first side and an opposite second side;

a framework, wherein said framework includes a cross beam having a central pivot connection between a first end and a second end that enables said cross beam to rotate in a vertical plane about said central pivot connection throughout a predetermined range of motion, wherein said first end and said second end simultaneously move in opposite directions up and down in said vertical plane when said cross beam is rotated about said central pivot connection during exercise by a user;

a first handle;

a second handle;

mounting flanges located at said first end and said second end of said cross beam;

a first elastic resistance element that connects said first handle to a first of said mounting flanges at said first end of said cross beam, wherein said first end is offset to said first side of said support platform;

a second elastic resistance element that connects said second handle to a second of said mounting flanges at said second end of said cross beam, wherein said second end is offset from said second side of said support platform;

wherein said first elastic resistance element resists movement of said first handle by resisting being pulled in tension by a user during exercise beyond a predetermined distance from said first point;

wherein said second elastic resistance element resists movement of said second handle by resisting being pulled in tension by a user during exercise beyond a predetermined distance from said second point;

a first anchor element that interconnects said first elastic resistance element to said first of said mounting flanges;

a second anchor element that interconnects said second elastic resistance element to said second of said mounting flanges;

wherein said anchor elements are connected to said mounting flanges with pivot connections and said device further includes a mechanism for locking said anchor elements in a selective angular orientation relative said mounting flanges.

9. The device according to claim 8, further including a locking mechanism for selectively locking said cross beam into a set position within said predetermined range of motion.

10. The device according to claim 9, wherein said framework includes a vertical post, wherein said cross beam is coupled to said vertical post by said central pivot connection.

11. The device according to claim 10, wherein said central pivot connection can be selectively connected to said vertical post at different heights along said vertical post.

* * * * *